US006828885B1

(12) United States Patent
Dedenbach et al.

(10) Patent No.: US 6,828,885 B1
(45) Date of Patent: Dec. 7, 2004

(54) CIRCUIT BREAKER AND METHOD FOR PRODUCING SAME

(75) Inventors: Guido Dedenbach, Bonn (DE); Klaus Ochtinger, Dienethal (DE); Carsten Rusteberg, Darmstadt (DE); Lutz Thilker, Leichlingen (DE)

(73) Assignee: Moeller GmbH, Bonn (DE)

( * ) Notice: Subject to any disclaimer, the term of this patent is extended or adjusted under 35 U.S.C. 154(b) by 0 days.

(21) Appl. No.: 09/890,685

(22) PCT Filed: Feb. 1, 2000

(86) PCT No.: PCT/EP00/00809

§ 371 (c)(1),
(2), (4) Date: Jan. 18, 2002

(87) PCT Pub. No.: WO00/46824

PCT Pub. Date: Aug. 10, 2000

(30) Foreign Application Priority Data

Feb. 4, 1999 (DE) ..... 199 04 355

(51) Int. Cl.[7] ..... H01H 83/00

(52) U.S. Cl. ..... 335/16; 218/22; 335/202; 335/132

(58) Field of Search ..... 335/8–10, 16, 335/147, 165–176, 202, 132, 195; 218/22, 151–157; 200/293–308

(56) References Cited

U.S. PATENT DOCUMENTS

| | | | | |
|---|---|---|---|---|
| 5,029,301 A | | 7/1991 | Nebon et al. | 335/16 |
| 5,196,815 A | * | 3/1993 | Chien et al. | 335/16 |
| 5,313,180 A | | 5/1994 | Vial et al. | 335/16 |
| 5,428,883 A | * | 7/1995 | Stieglitz | 29/602.1 |
| 5,719,365 A | * | 2/1998 | Tanimizu et al. | 218/118 |
| 6,037,555 A | * | 3/2000 | Castonguay et al. | 335/202 |

FOREIGN PATENT DOCUMENTS

| | | |
|---|---|---|
| DE | 3146854 | 8/1982 |
| DE | 19812273 | 10/1997 |
| EP | 0560696 | 9/1993 |

* cited by examiner

*Primary Examiner*—Lincoln Donovan
(74) *Attorney, Agent, or Firm*—Davidson, Davidson & Kappel, LLC

(57) ABSTRACT

A circuit-breaker including a an interrupter chamber housing that includes a plastic material and houses an interrupter. The interrupter includes at least one stationary contact member, which, via a busbar is connected to a corresponding connecting terminal and a moveable contact member that is moveable connectable to the stationary contact member. To ensure that heat generated by the busbar is more rapidly released into the switch compartment housing the busbar is imbedded in an outer wall of the interrupter chamber housing and in contact with the housing by a form fit or a force fit.

10 Claims, 1 Drawing Sheet

CIRCUIT BREAKER AND METHOD FOR PRODUCING SAME

RELATED TECHNOLOGY

The present invention relates to a circuit beaker having an interrupter chamber housing composed of plastic and an interrupter arranged in the interrupter chamber housing and having a busbar disposed inside an outside wall of the interrupter housing.

European Patent Document EP 0 560 696 B1 describes a circuit breaker featuring a rotary double-break interrupter, the interrupter chamber housing being composed of two housing modules. The interrupter includes two stationary contact members which are each connected to corresponding connecting terminals via loop-shaped busbars, and a two-arm contact member which is rotatable about an axis and which interconnects the two stationary contacts in its closed position. For mounting the stationary contact members in the interrupter chamber housing in this circuit breaker, these stationary contacts members are inserted together with the busbars into corresponding receptacles of the interrupter chamber housing which are intended for this. In this circuit breaker, it is disadvantageous, inter alia, that the heat generated during the normal use of the busbars is transferred to the interrupter chamber housing relatively slowly because the air surrounding the busbar is a very poor heat conductor. Besides, the busbars which are inserted into the receptacles of the interrupter chamber housing require an additional fixation to guarantee a sufficient strength in the region of the connecting terminals.

SUMMARY OF THE INVENTION

An object of the present invention is to specify a circuit breaker of the type mentioned at the outset in which the heat generated by the busbars is readily dissipated into the interrupter chamber housing more rapidly than in known comparable circuit breakers. Moreover, an intention is to provide a method for manufacturing a circuit breaker of that kind.

The present invention provides a circuit breaker having an interrupter chamber housing composed of plastic and an interrupter which is arranged in the interrupter chamber housing and which includes at least one stationary contact member which is connected to a corresponding connecting terminal via a busbar, as well as a pivoting or sliding contact member which, in its closed position, can be connected to the stationary contact member. The busbar is arranged inside the outside wall of the interrupter chamber housing, and connected thereto over a large surface in a positive locking and/or force-locking manner. The busbar is injection-molded around with the plastic which forms the outside walls of the interrupter chamber housing. The present invention further provides a method for manufacturing such a circuit breaker wherein the respective busbar and, possibly, a blowout magnet allocated to the busbar, are brought into a mold for manufacturing the interrupter chamber housing as inserts. The manufacture of the interrupter chamber housing is then carried out by injection molding.

According to the present invention, the conductors are not inserted in corresponding receptacles and fixated using additional means subsequent to the manufacture of the interrupter chamber housing as in the known circuit breakers but, instead, are brought into the outside walls of the interrupter chamber housing already during its manufacture and connected thereto over a large surface (that is virtually over the entire surface) in a positive locking and/or force-locking manner. Such a connection between the busbars and the outside walls of the interrupter chamber housing can be effected by manufacturing the respective interrupter chamber housing by injection molding, the busbars being inserted into the corresponding mold prior to injection molding.

In the case of loop-shaped busbars having blowout magnets arranged between the legs of the busbars (cf., for example, European Patent Document EP 0 560 696 B1 mentioned at the outset), the blowout magnets can also be fixated in the corresponding mold together with the busbars and subsequently molded into the side walls of the interrupter chamber housing during its manufacture. In this manner, both a stable fixation of the respective blowout magnet within the interrupter chamber housing and the required insulation of the respective blowout magnet against the corresponding busbar is achieved in a simple manner.

The circuit breaker according to the present invention not only has the advantage that a good heat transfer takes place from the heated busbars into the interrupter chamber housing surrounding them but also guarantees a high strength of the busbars in the region of the connecting terminals and in the region of the contacts which are subject to high dynamic loads.

A further advantage of the busbars, which are imbedded, such as by being injection-molded around, consists in the mechanically highly firm fixation of the rails in the housing, a later change of the positions of the contacts being ruled out.

BRIEF DESCRIPTION OF THE DRAWING

The present invention is elaborated on below based on exemplary embodiments with reference to the drawing, in which.

DETAILED DESCRIPTION

Figure 1:
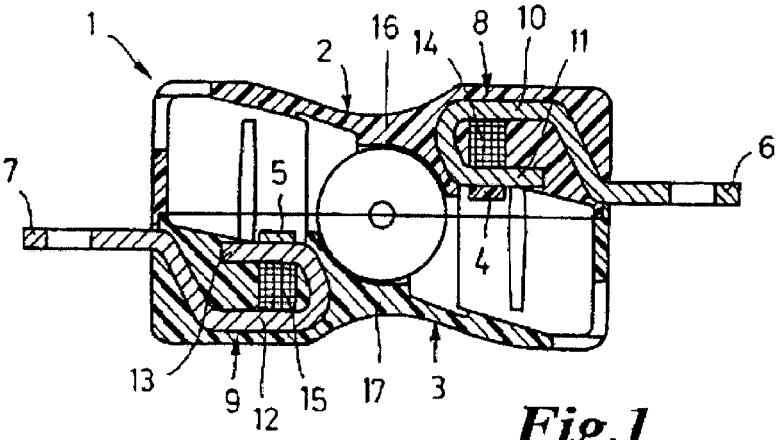
FIG. 1 shows a longitudinal section through an interrupter chamber housing according to the present invention.

In FIG. 1, reference numeral 1 denotes the interrupter chamber housing of a circuit breaker featuring a rotary double-break interrupter, the interrupter chamber housing being composed of two identical housing modules 2 and 3 made of plastic. Each of the two housing modules 2, 3 includes a stationary contact member 4, 5 which can be connected via a pivoting contact member which is not shown for reasons of clarity. Arranged between stationary contact members 4, 5 and connecting terminals 6, 7 provided outside of the interrupter chamber housing is in each case a loop-shaped busbar 8, 9, a blowout magnet 14, 15 being arranged between the two legs 10, 11 and 12, 13 of busbars 8, 9, respectively.

According to the present invention, both busbars 8, 9 and blowout magnets 14, 15 are at least partially imbedded in outside walls 16, 17 of housing modules 2, 3 of interrupter chamber housing 1, and firmly connected to these outside walls over a large surface on the peripheral side so that a good heat transfer takes place from busbars 8, 9 to the plastic of outside walls 16, 17 which surrounds the rails. In this context, a high heat transfer from busbars 8, 9 to outside walls 16, 17 of housing modules 2, 3 ensues, in particular, if the housing modules 2, 3 are manufactured by injection molding, and busbars 8, 9 and blowout magnets 14, 15 are brought into the corresponding molds for manufacturing housing modules 2, 3 as inserts prior to injection molding.

The present invention is of course not limited to the above described exemplary embodiment. Thus, for example, the circuit breaker does not necessarily have to be one featuring a rotary double-break interrupter. Rather the interrupter can also be equipped with a single-arm pivoting contact member (single-break interrupter) or with a translatorily movable contact member.

Moreover, it is conceivable for the interrupter chamber housing to be manufactured, for example, by transfer molding or by casting of reaction resins in lieu of injection molding. In manufacturing methods of that kind, the busbars of the circuit breaker and, possibly, the blowout magnets are also brought into the corresponding mold for manufacturing the interrupter chamber housing or its modules prior to the transfer molding or casting process to ensure an "intimate" connection over a large surface between the busbars and the plastic surrounding them.

What is claimed is:

1. A circuit breaker comprising:

an interrupter chamber housing having an outside wall of a plastic material;

an interrupter including a stationary contact member disposed in the interrupter chamber housing and a moveable contact member moveably connectable to the stationary contact member;

a connecting terminal corresponding to the stationary contact member; and a busbar injection molded into the outside wall and in contact with the outside wall over a large surface of the busbar so as to enhance heat transfer from the busbar to the outside wall, the busbar providing a connection between the stationary contact member and the corresponding connecting terminal.

2. The circuit breaker as recited in claim 1 wherein the busbar is imbedded into the outside wall by an injection molding process using the plastic material.

3. The circuit breaker as recited in claim 1 wherein the moveable contact member is at least one of a pivoting and a sliding contact member.

4. The circuit breaker as recited in claim 1 wherein the busbar is connected to the outside wall in at least one of a positive locking and force-locking manner.

5. The circuit breaker as recited in claim 1 wherein the busbar is loop-shaped.

6. The circuit breaker as recited in claim 5 further comprising a blowout magnet imbedded in the outside wall between a first leg and a second leg of the loop-shaped busbar.

7. The circuit breaker as recited in claim 1 further comprising a second connecting terminal and a second busbar wherein the interrupter is a rotary double-break interrupter that includes a second stationary contact member connected to the second terminal using the second busbar.

8. The circuit breaker as recited in claim 7 wherein the interrupter housing includes two housing modules, each housing module accommodating one of the stationary contact member and second stationary contact member.

9. A method for manufacturing a circuit breaker having an interrupter chamber housing including a plastic material and a busbar for connecting a stationary contact member and a connecting terminal, the method comprising:

selecting a mold;

positioning the busbar in the mold;

injecting the plastic material into the mold so as to surround a large surface area of the busbar so as to enhance heat transfer from the busbar to the interrupter chamber housing.

10. The method as recited in claim 9, further comprising he mold before the injecting of the plastic material.

* * * * *